US008661639B2

(12) United States Patent
Bondielli

(10) Patent No.: US 8,661,639 B2
(45) Date of Patent: Mar. 4, 2014

(54) MANUAL TOOL FOR APPLICATION OF A TILE LAYING DEVICE AND SIMILAR ARTICLES ON A SURFACE TO COAT

(75) Inventor: Mauro Bondielli, Massa (IT)

(73) Assignee: Mollificio Apuano S.R.L., Massa (IT)

( * ) Notice: Subject to any disclaimer, the term of this patent is extended or adjusted under 35 U.S.C. 154(b) by 0 days.

(21) Appl. No.: 13/388,104

(22) PCT Filed: Aug. 2, 2010

(86) PCT No.: PCT/IB2010/001902

§ 371 (c)(1),
(2), (4) Date: Feb. 27, 2012

(87) PCT Pub. No.: WO2011/012994

PCT Pub. Date: Feb. 3, 2011

(65) Prior Publication Data

US 2012/0144773 A1 Jun. 14, 2012

(30) Foreign Application Priority Data

Jul. 31, 2009 (IT) ..... PI2009A0098

(51) Int. Cl.
*B23P 11/00* (2006.01)

(52) U.S. Cl.
USPC ..... 29/243.5; 29/270; 29/278

(58) Field of Classification Search
USPC ..... 29/243.5, 243.53, 244, 255, 270, 278; 269/3, 6
See application file for complete search history.

(56) References Cited

U.S. PATENT DOCUMENTS

| | | | | |
|---|---|---|---|---|
| 4,397,125 | A | 8/1983 | Gussler, Jr. | |
| 5,193,592 | A | 3/1993 | Evilsizer et al. | |
| 5,345,663 | A | 9/1994 | Scruggs | |
| 5,881,452 | A * | 3/1999 | Nowell et al. | 29/816 |
| 6,113,073 | A * | 9/2000 | Lefavour et al. | 254/18 |
| 6,216,326 | B1 * | 4/2001 | Ritter et al. | 29/252 |
| 6,473,955 | B1 * | 11/2002 | Huang | 29/268 |
| 8,156,626 | B1 * | 4/2012 | Doty | 29/267 |
| 8,393,063 | B2 * | 3/2013 | Hodges et al. | 29/239 |
| 2010/0229698 | A1 | 9/2010 | Shawcross et al. | |
| 2012/0144773 | A1 * | 6/2012 | Bondielli | 52/747.11 |

FOREIGN PATENT DOCUMENTS

| | | |
|---|---|---|
| FR | 2 677 572 | 12/1992 |
| GB | 2 195 732 | 4/1988 |
| GB | 2 240 601 | 8/1991 |
| WO | WO 2005/039923 | 5/2005 |

* cited by examiner

*Primary Examiner* — Lee D Wilson
(74) *Attorney, Agent, or Firm* — Ladas & Parry LLP

(57) ABSTRACT

Manual tool for application of a tile laying device to tiles to coat, including a working head having a support surface that is arranged next to a face of a portion of the device. The working head has a side opening through which the band member, connected to a portion of the device and protruding from the second portion through the tiles, is arranged. The tool includes a tensioning device means that is adapted to engage with the band member and to apply on the band member a tension T1 to arrange the device between a first position and a second position.

30 Claims, 12 Drawing Sheets

Fig. 11
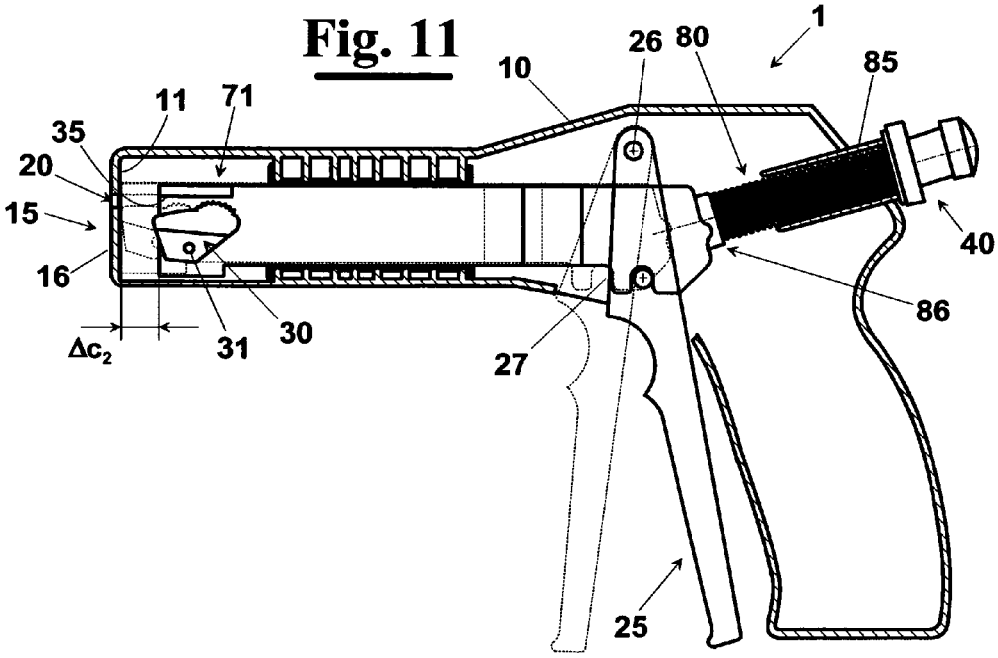
Fig. 12A
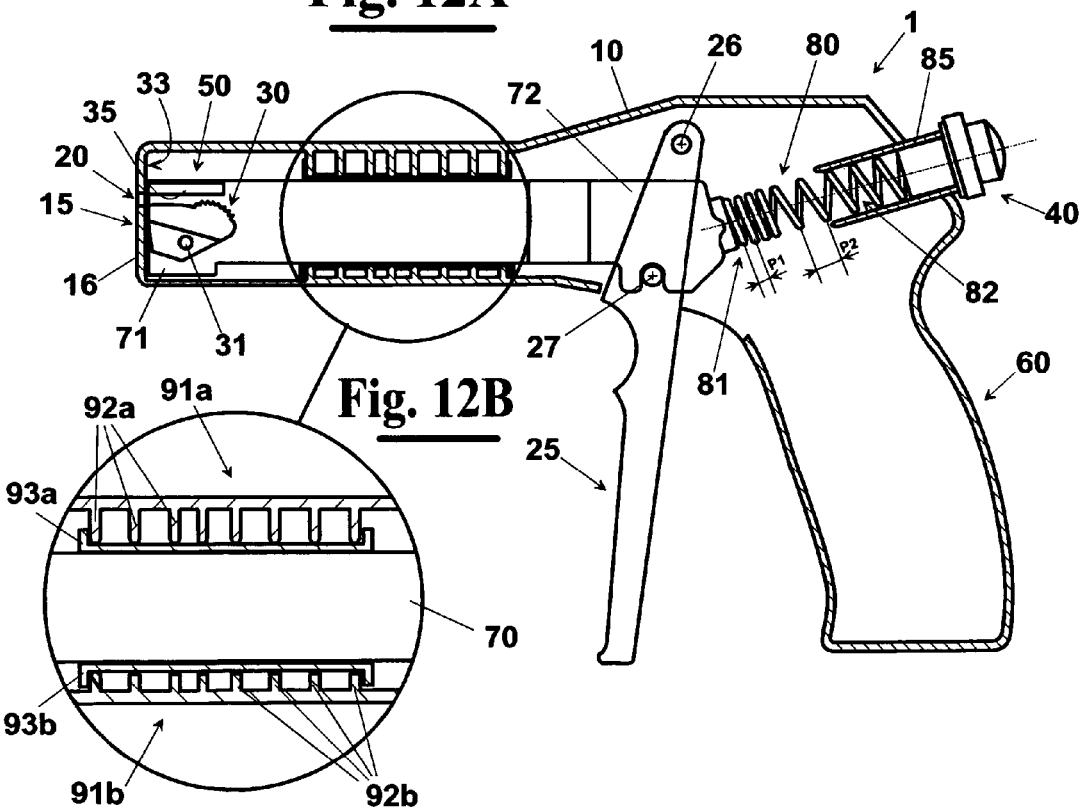
Fig. 12B

MANUAL TOOL FOR APPLICATION OF A TILE LAYING DEVICE AND SIMILAR ARTICLES ON A SURFACE TO COAT

This application is a 371 of PCT/IB2010/001902, filed on Aug. 2, 2010, which claims priority to Italian Patent Application No. PI2009A000098, filed Jul. 31, 2009, both of which are incorporated herein by reference.

FIELD OF THE INVENTION

The present invention relates to the building industry and, in particular, it relates to a manual tool for application of a tile laying device and similar articles on a surface to coat.

DESCRIPTION OF THE PRIOR ART

As well known, the laying steps of tiles, bricks, and boards of different material on a surface to coat provides a critical step, so called "levelling", during which a operator arranges the tiles so that the visible surfaces are at a same level.

To assist the operator during this critical and essential phase of the laying steps, suitable clip devices can be used as described below with reference to FIGS. from 1 to 4.

In particular, as shown in FIGS. from 1 to 4, a clip device 100 of known type for levelling tiles 150 on a surface 200 to coat comprises a first portion 110, for example with substantially planar shape, equipped with a first face 111 that, in use, is oriented towards the surface to coat 200, and a second face 112, which in use is oriented towards two adjacent tiles 150*a* and 150*b*. Device 100 comprises, furthermore, a second portion 120 that is slidingly mounted with respect to the first portion along a band member 160 and is arranged, in use, opposite to first portion 110 with respect to tiles 150*a* and 150*b*. More in detail, band member 160 is made of plastic material and is arranged, in use, between tiles 150*a* and 150*b* and has an end 161 constrained to first portion 110 and a free end 162 protruding, in use, from second portion 120 (FIG. 2).

First and second portions 110 and 120 are movable relative to each other between a first position, in which they are arranged at a distance d larger than the thickness s of tiles 150*a* and 150*b* (FIG. 2), and a second position, in which they are arranged at a distance substantially equivalent to the thickness s of tiles 150*a* and 150*b* (FIG. 3). More precisely, in the second position portions 110 and 120 of device 100 are arranged adjacent to the respective faces, on which they apply a compression force that is high enough for bringing the tiles at a same level.

Clip device 100 is then left at this configuration until a glue layer 250 dries, which is laid between surface 200 and tiles 150. Then, device 100 is removed tearing band member 160. Then, a filler, or different material for the building industry, is applied to fill the slits between tiles 150*a* and 150*b*. The use of clip device 100, as above described, assists and speeds up the correct arrangement of tiles 150 on surface 200 and avoids the use of levelling tools and similar articles.

A first example of a similar tile laying device is disclosed in WO2009022359.

Another example of a clip tile laying device is disclosed in WO9214012.

Devices 100 are applied and removed manually by the operator, or, like the case disclosed in WO9214012, they are applied manually and removed by a sudden hit, once hardened the glue arranged between the surface to coat and the tile. Therefore, even if assisting the laying steps of tiles with respect to traditional techniques, device 100 causes, in any case, hard work by the operator, for both the force that in any case has to be applied to pull band member 160 during the two main phases, and for the number of times that the above actions have to be repeated for completing the coating of a surface.

Also the use of manual pulling instruments, such as clamps and similar articles, for example of the type described in GB2060467, even if assisting in part the operator when applying the force on band member 160, has some drawbacks.

In particular, the use of a gripper has the risk that band member 160 can break at the gripping point, instead of breaking at first portion 110. Therefore, band member 160 may remain broken and visible within the slits 155 between tiles 150, affecting the step of application of filler, or similar material.

SUMMARY OF THE INVENTION

It is then a feature of the present invention to provide a manual tool for application of a tile laying device and similar articles on a surface to coat that is adapted to overcome the difficulties of the prior art.

It is, also, a feature of the present invention to provide such a manual tool that is structurally easy and cost effective.

It is, furthermore, a feature of the present invention to provide such a manual tool that is light and not much cumbersome.

It is, a further feature of the present invention to provide such a manual tool to assist and speed up the step of applying the clip devices for laying tiles.

These and other features are accomplished with one exemplary manual tool for application of a tile laying device and similar articles on a surface to coat, said tiles having a predetermined thickness, said tile laying device comprising:

- a first portion with flat shape equipped with a first face that, in use, is oriented towards said surface to coat and a second face that, in use, is oriented towards a first and a second tile at a slit between said tiles;
- a band member protruding from said second face of said first portion, said band member arranged, in use, between said tiles at said slit;
- a second portion slidingly arranged along said band member opposite to said first portion in order to be located between a first position, in which the distance between the first portion and the second portion is larger than the thickness of said tiles, and a second position, in which the distance between the first portion and the second portion is equal to said thickness of said tiles and said second portion pushes said tiles against said first portion in such a way that it brings them to a same level;

wherein the main feature of said manual tool is that it comprises:

- a handgrip for a user;
- a working head equipped with a support surface, said support surface adapted to be located, in use, next to the second portion of said tile laying device opposite to said tiles;
- an opening made in said working head, such that said band member can be inserted/extracted into/away from said opening;
- a tensioning means arranged opposite to said tile laying device with respect to said support surface, said tensioning means adapted, in use, to engage with said band member of said tile laying device put in said opening for applying on said band member a tension up to reaching a predetermined tension T1 so that said working head pushes said second portion towards said first portion for causing a pushing and levelling action of said tiles between said first and said second portion.

Advantageously, the manual tool comprises a hollow body having said handgrip, working head and said opening made in said working head. In particular, the band member is inserted/extracted into/away from the hollow body through the above described opening.

In particular, the tensioning means can house in said hollow body.

Advantageously, the tensioning means besides having a tension T1 on the strap, is adapted to apply an additional tension T2 on it, with T2>T1, said additional tension T2 suitable for causing the disengagement of the band member from the tile laying device.

Advantageously, the tensioning means comprises a lock means that is adapted to move from a releasing position, in which it releases the band member, to a locking position, in which it locks the band member and applies on it tension T1, or tension T2, with T2>T1.

In particular, when the lock means is in the locking position, the band member is subject to a tension T1, or to a tension T2.

Advantageously, the tensioning means comprises an actuating means that is adapted to bring the lock means from the actual releasing position to the locking position.

In particular, the actuating means is adapted to bring the lock means from the actual releasing position, in which it contacts an abutment surface opposite to the support surface, to the locking position, in which the lock means is distanced from the abutment surface.

Advantageously, the movement of the lock means from the actual releasing position to the locking position is biased by resilient means. In particular, the resilient means is adapted to return the lock means by locking position to the releasing position.

In a possible exemplary embodiment, the actuating means is adapted to rotate the lock means from the actual releasing position to the locking position.

In particular, the above described rotation from the actual releasing position to the locking position is biased by resilient means.

In an exemplary embodiment, the actuating means is adapted to translate the lock means from the actual releasing position to the locking position.

In particular, the above described step of translating the lock means from the actual releasing position to the locking position is biased by resilient means.

In particular, the lock means can comprise:

an abutment surface;

an lock member movable between a releasing position, in which it is at a distance from the abutment surface, to make it possible bringing the band member between them, in particular through said opening, and a locking position, in which the band member is pressed between the lock member and the abutment surface.

Advantageously, the resilient means is configured such that in a rest position it forces a shoulder portion of the lock member against a contrast surface maintaining it at a distance from the abutment surface.

In a possible embodiment, the abutment surface and the lock member are mounted on the actuating means.

Advantageously, the lock member is pivotally connected to one end portion of the actuating means and the abutment surface is integral to a same end portion of the actuating means.

In particular, the end portion has a cross section comprising a plurality of rectilinear segments arranged in order to form substantially a "C", said abutment surface being coincident to one of said rectilinear segments.

Preferably, the lock member has a toothed profile at the surface oriented towards the abutment surface.

In particular, the toothed profile of the lock member has a plurality of teeth having an angle of incidence set between 5° and 120°.

In particular, the actuating means comprises:

a translating element that can translate along a sliding direction biased by resilient means;

an actuating lever operatively connected to said translating element on which a user can act for bringing the manual tool from a rest configuration, in which said translating element is in an advanced position and said lock means is in said position at a distance from the abutment surface, to an operative configuration, in which said translating element is in a withdrawn position and said lock means is in said locking position.

Advantageously, the lock member is associated with a torsion spring. In particular, the torsion spring is adapted to apply a resilient torque on the lock member up to bringing it to the locking position. More precisely, in a rest position the resilient means applies on the translating element a resilient force larger than the resilient force of the torsion spring such that they force the lock member against the abutment surface maintaining it in the releasing position, in which it is possible to put the band member between the lock member and the abutment surface. In the operative configuration, instead, the user acts on the actuating lever exceeding the resilient force of the resilient means, causing the withdrawal of the translating element with respect to the support surface and the subsequent movement of the lock member from the actual releasing position to the locking position by the torsion spring. When the actuating lever is released, the resilient means forces again the lock member against the hollow abutment surface bringing it back to the releasing position, in which the band member is not subject to any tension and it is therefore possible to extract it from the hollow containing body through the opening of the working head.

In particular, the resilient means can apply a resilient force oriented along a pushing direction parallel to the sliding direction.

Alternatively, the resilient means can apply a resilient force oriented along a pushing direction at a predetermined angle with respect to the sliding direction.

Advantageously, the opening through which the band member is inserted into the working head comprises a first portion that is located at the support surface and a second portion that is located at a side face of the working head.

Advantageously, furthermore, an adjustment means is provided for adjusting the resilient force, i.e. the load, of said resilient means.

Advantageously, the adjustment means is adapted to set a predetermined load of the resilient means. In particular, the adjustment means is adapted to set a predetermined resilient force, or load, among a plurality of selected resilient forces. More in detail, the adjustment means is adapted to set a larger load when the tensioning means applies the above described tension T1 on the band member and a lighter load when the tensioning means applies the above described tension T2 on the strap.

In particular, the translating element can be slidingly mounted between a couple of guides arranged at opposite sides with respect to the translating element.

Advantageously, each guide comprises a plurality of projections oriented towards the recess of the hollow containing body. Preferably, between each plurality of projections and the translating element a metal sheet can be located, for example of bronze, that is adapted to reduce the friction during the sliding movement of the translating element.

Advantageously, the resilient means has a plurality of coils. More in detail, the resilient means comprises an adjustable pitch of the coils. In particular, the resilient means comprises at least one first part having coils with a first pitch P1 and at least one second part having coils with a second pitch P2, with P2>P1.

Advantageously, the translating element has a profiled shape comprising:

- a head portion arranged on a first plane, to said head portion said lock member being pivotally connected;
- a tail portion arranged on a second plane parallel to said first plane and arranged at a predetermined distance from it, said tail portion being constrained to said actuating lever;
- a connection portion between the head portion and the tail portion.

Advantageously, is provided a partition wall arranged between the lock member and the guide of the translating element. More in detail, the presence of the partition wall avoids that dust and debris of various nature can penetrate in the mechanical parts of the tool jeopardizing the correct operation.

In particular, the actuating lever is pivotally connected to the manual tool, or to the hollow containing body if the latter is provided, in a first point with respect to which it can rotate and engages with the translating element at a second point, the rotation of said actuating lever about said first point causing the translating element to slide along said sliding direction.

Advantageously, the resilient means is arranged according to a guide that is adapted to avoid undesired lateral movements.

In particular, a means can be provided for stopping the translating element to slide at a predetermined distance from the support surface. More in detail, the distance at which the translating element is stopped from sliding corresponds to the stroke of the translating element for bringing the first and the second portion of the device from the first to the second position.

In particular, the translating element and the resilient means have mutual engagement means.

Advantageously, the mutual engagement means comprises a connecting element that is adapted to be arranged between the mutual engagement means and the translating element, said connecting element having a first engagement means for engaging it with said resilient means and a second engagement means for engaging it with said translating element.

For example, the second engagement means of the connecting element can comprise a recess on the edge oriented towards the translating element, said recess adapted to engage with a corresponding projection made on the edge of the translating element oriented towards the connecting element.

In an exemplary embodiment of the invention, the actuating means comprises a first and a second jaw having respective handgrip portions and pivotally connected to each other.

In particular, the first and the second jaws are adapted to rotate with respect to a rotation point, or pivot point, biased by resilient means, for example a torsion spring, for moving from a rest configuration, in which the handgrip portions are at a distance from each other and the band member that is put in the opening is not subject to any traction force, and a tension configuration, in which the handgrip portions are close to each other to each other and the band member that is put in the opening is subject to a traction force.

Advantageously, the lock means is in said releasing position when said handgrip portions of said first and of said second jaws are at a distance from each other and is in a locking position when said handgrip portions of said first and of said second jaws are close to each other to each other.

Advantageously, the lock member and the abutment surface are integral to the first jaw, whereas the support surface is integral to the second jaw. Therefore, by rotating the jaws about the pivot point the lock member moves away from the support surface and then it moves from the releasing position to the locking position.

In particular, a first torsion spring is provided that is adapted to oppose to the movement of the handgrip portions of the first and of the second jaws from the distant position to the approached position and a second torsion spring is provided associated with the lock member up to bringing it to the locking position. More precisely, in a rest position the first torsion spring produces on the jaws a resilient force larger than that of the second torsion spring on the lock member. When, instead, the user locks the first and the second jaws exceeding the resilient force of the first torsion spring the handgrip portions of the first and of the second jaws approach each other and the lock member is brought away from the abutment surface. This allows second torsion spring to bring the lock member from the actual releasing position back to the locking position.

According to another aspect of the invention, a method for application of a tile laying device and similar articles on a surface to coat, said method comprising the steps of:

- bringing a support surface of the working head of a tool next to a second portion of a tile laying device, or similar articles, said device having:
  - a first portion with flat shape equipped with a first face that, in use, is oriented towards said surface to coat and a second face that, in use, is oriented towards a first and a second tile at a slit between said tiles;
  - a band member protruding from said second face of said first portion, said band member arranged, in use, between said tiles at said slit;
  - a second portion slidingly arranged along said band member opposite to said first portion in order to be located between a first position, in which the distance between the first portion and the second portion is larger than the thickness of said tiles, and a second position, in which the distance between the first portion and the second portion is equal to said thickness of said tiles and said second portion pushes said tiles against said first portion in such a way that it brings them to a same level;
- arranging said band member in a opening made in said working head;
- tensioning said band member through a tensioning means arranged opposite to said tile laying device with respect to said support surface, said tensioning means adapted, in use, to engage with said band member of said tile laying device inserted through said opening for applying on said band member a tension up to reaching a predetermined tension T1, so that said working head pushes said second portion towards said first portion for causing a pushing and levelling action of said tiles between said first and said second portion.

BRIEF DESCRIPTION OF THE DRAWINGS

The invention will be made clearer with the following description of an exemplary embodiment thereof, exemplifying but not limitative, with reference to the attached drawings in which:

FIGS. from 1 to 4 show diagrammatically in partial front views a succession of steps through which the application is made of a tile laying device and similar articles, according to the prior art;

Figure 1:
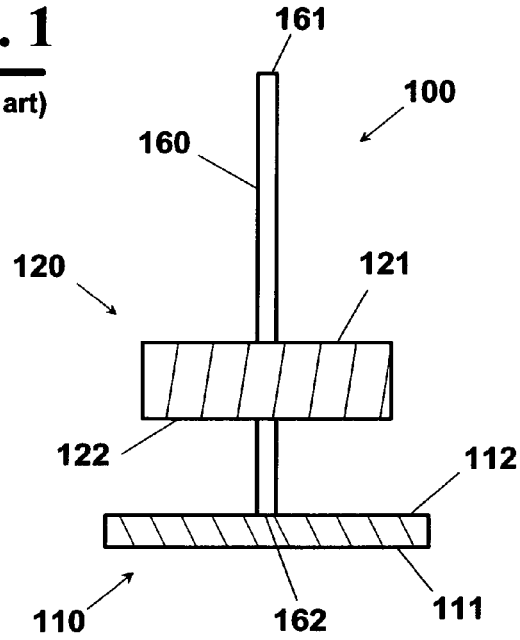
Fig. 1 (prior art)
Figure 2:
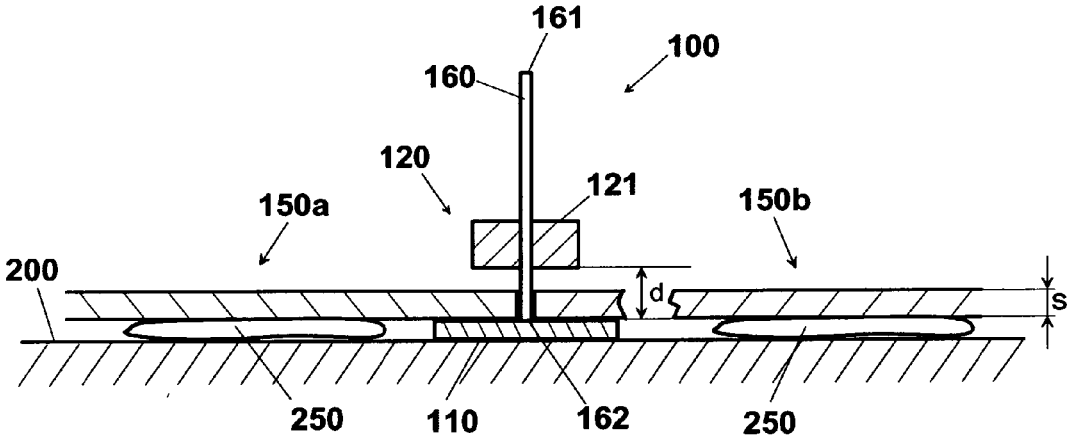
Fig. 2 (prior art)
Figure 3:
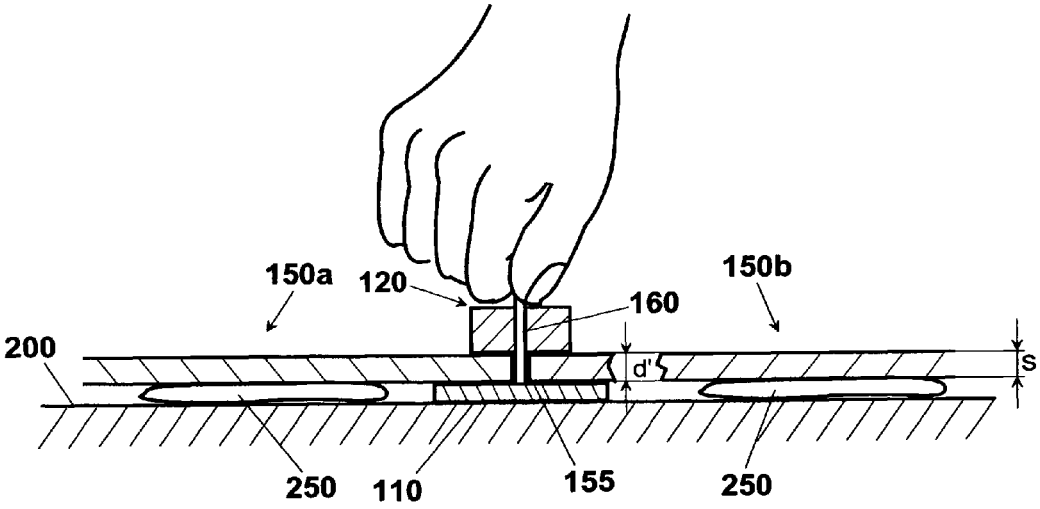
Fig. 3 (prior art)
Figure 4:
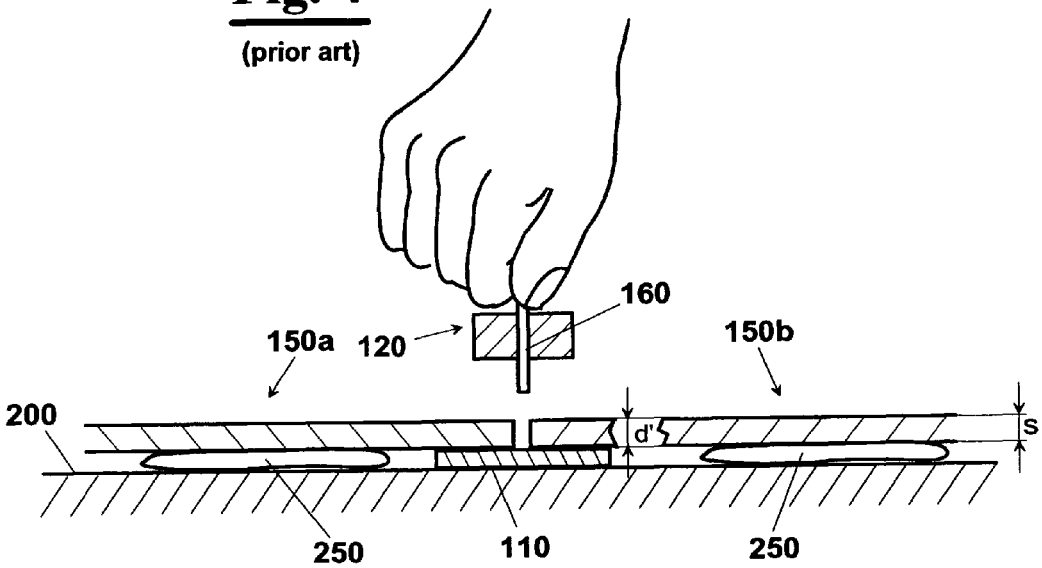
Fig. 4 (prior art)
Figure 5:
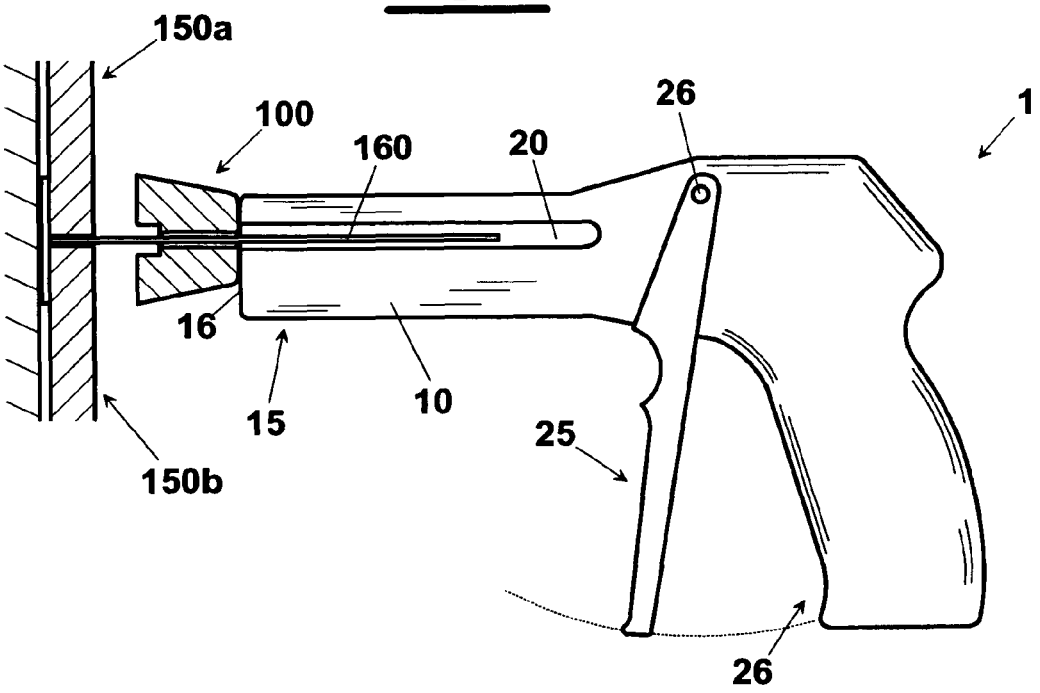

FIGS. from 5 to 7 show diagrammatically a front view of a succession of steps through which the application is made of a tile laying device and similar articles, using the manual tool according to the invention;

FIGS. from 8 to 19 show diagrammatically in cross sectional views some exemplary embodiments of the manual tool for application of a tile laying device and similar articles, using the manual tool according to the invention;

FIGS. from 20 to 22 show diagrammatically further exemplary embodiments of the manual tool of FIG. 5.

DETAILED DESCRIPTION OF SOME EXEMPLARY EMBODIMENTS

Figure 6:
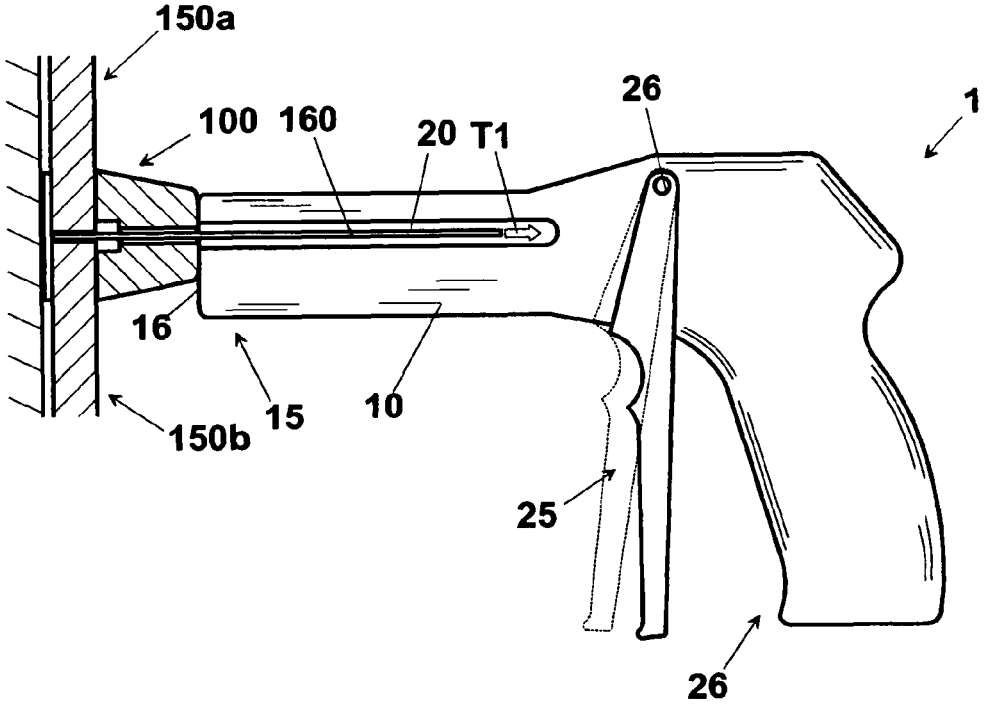
Figure 8:
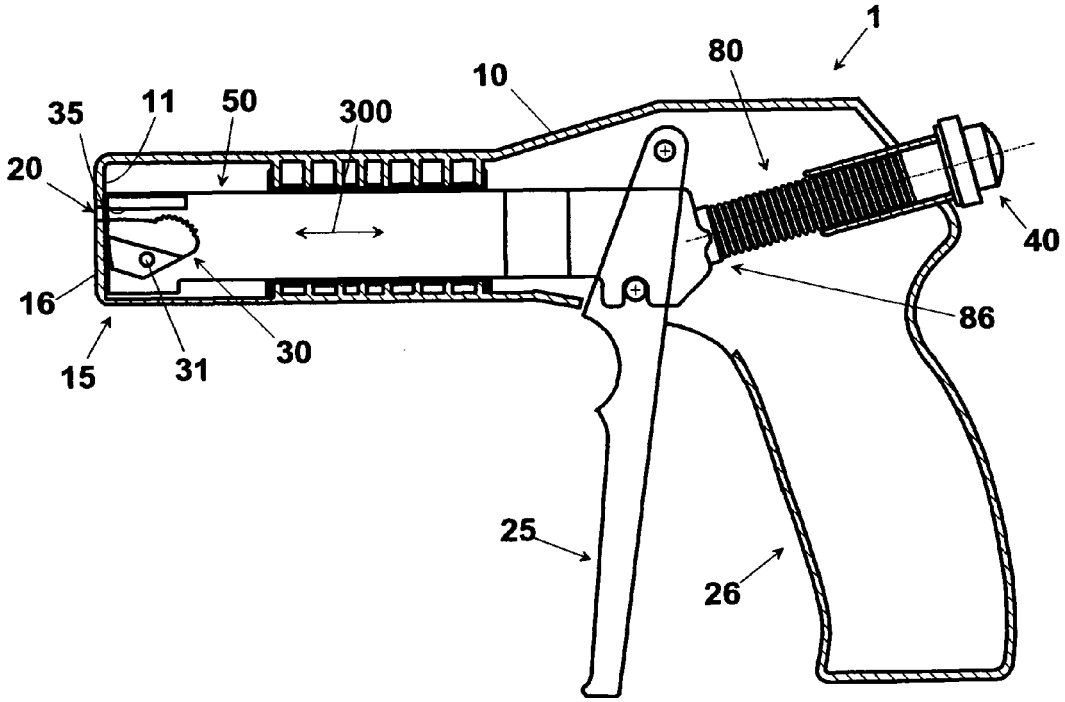

With reference to FIG. 5, a first exemplary embodiment of a manual tool 1, according to the invention, for application of a clip device 100 for laying tiles 150*a* and 150*b* on a surface 200 to coat, comprises a working head 15 having a support surface 16. The latter is arranged, in use, next to a face 122 of a second portion 120 of device 100 (FIGS. 1-4). In particular, face 122 is opposite to a face 121 oriented towards tiles 150*a* and 150*b*. At working head 15 a side opening 20 is provided that is adapted to receive a band member 160. Tool 1 comprises, furthermore, a tensioning means 50 arranged opposite to device 100 with respect to support surface 16 (FIG. 8). In an exemplary embodiment, tool 1 has a hollow containing body 10. In this case, tensioning means 50 can be arranged in hollow containing body 10 and band member 160 is inserted/extracted into/away from hollow containing body 10 through opening 20. Tensioning means 50 is adapted to engage with band member 160 and to apply on it a predetermined tension that causes it to move from a rest configuration (FIG. 5), in which portions 110 and 120 of device 100 are located in the first position, to a tension configuration (FIG. 6), in which a free end 161 of band member 160 is at a distance from support surface 16 with respect to a rest position and portions 110 and 120 of device 100 are located in the second position.

Figure 7:
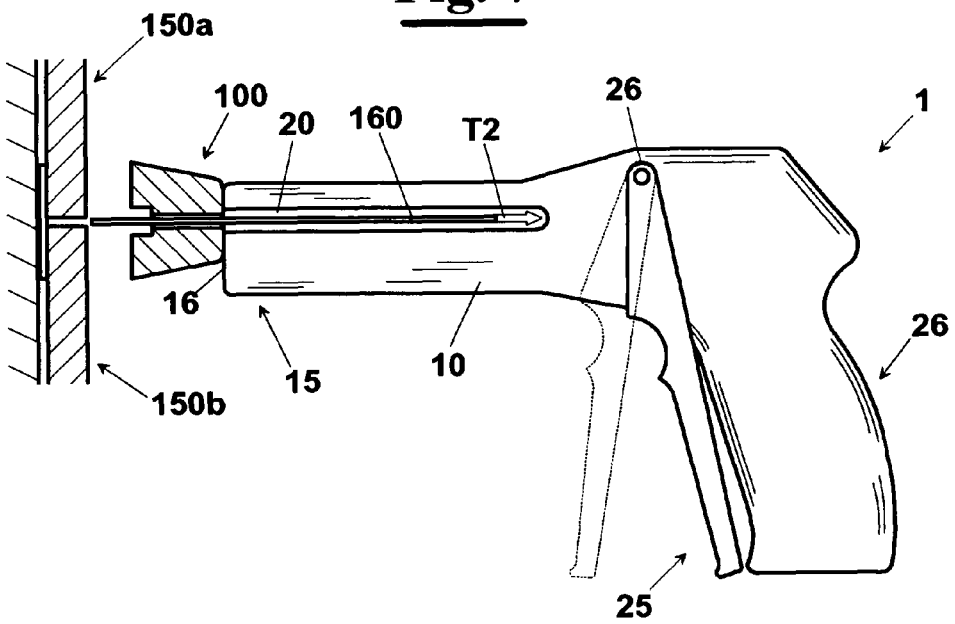

When removing device 100, instead, tensioning means 50 apply on band member 160 a predetermined additional tension T2 that causes it to break from portion 120 and, then to turn into a disengaged configuration (FIG. 7).

In particular, tensioning means 50 comprises a lock means that is adapted to move from a releasing position, in which it is possible to put band member 160 into working head 15 through opening 20, to a locking position, in which the lock means applies to band member 160 tension T1, or tension T2.

Figure 13:
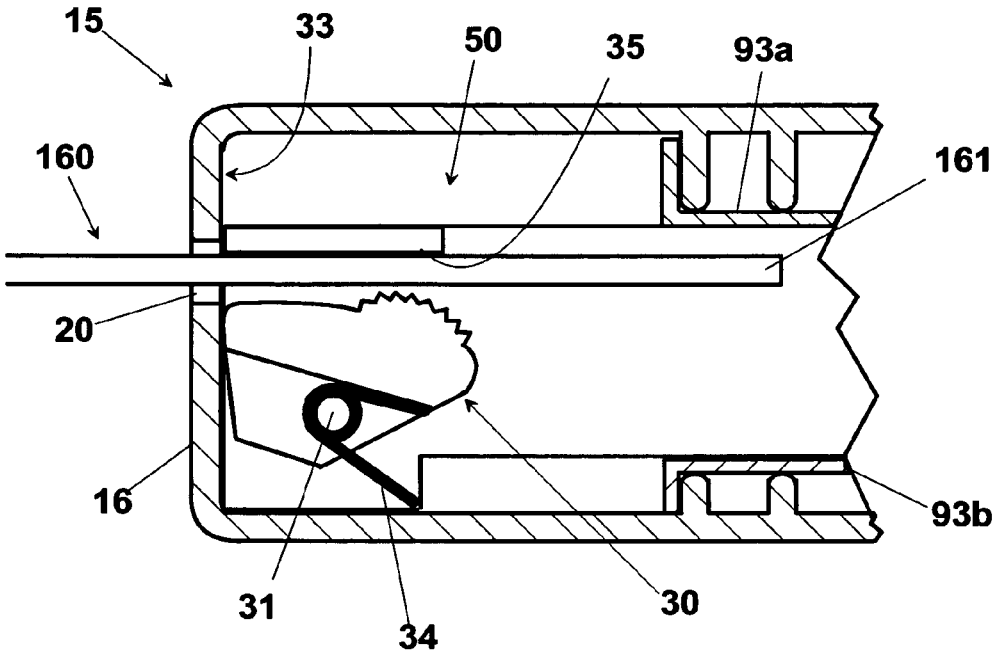
Figure 14:
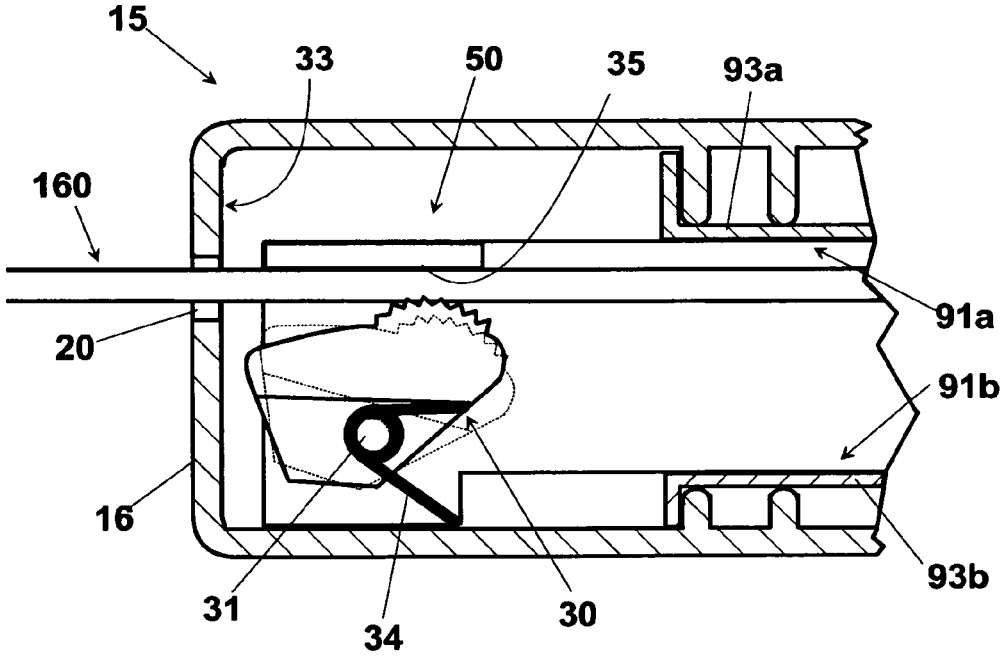

The lock means can, for example, comprise a lock member 30 that operates in combination with an abutment surface 35 to tension band member 160. More precisely, lock member 30, at a surface 30*a* that is oriented towards abutment surface 35, has a toothed profile comprising a plurality of sharp teeth and is movable with respect to abutment surface 35 between a releasing position, in which it is possible to arrange band member 160 (FIG. 13) between them, and a locking position, in which band member 160 is pressed between them, and is subject to a predetermined tension (FIG. 14). Furthermore, a torsion spring 34 is provided suitable to force lock member 30 against a contrast surface 33 opposite to support surface 16. More in detail, the torsion spring is adapted to return lock member 30 back to the releasing position once ended the step of tensioning band member 160.

In an exemplary embodiment shown in FIGS. from 1 to 19, tensioning means 50 is operatively connected to an operation lever 25 on which a user can act, holding tool 1 at a handgrip 60, for bringing lock member 30 from the actual releasing position to the locking position and for applying then a predetermined tension to band member 160. More precisely, operation lever 25 is pivotally connected to hollow body 10 at a point 26 with respect to which it is capable of rotating. Operation lever 25 and lock member 30 are operatively connected to each other by means of a translating element, or carriage 70, slidingly mounted along a sliding direction 300.

More precisely, translating element 70 is slidingly mounted between a couple of guides 91*a* and 91*b*, which are arranged at opposite sides with respect to it and comprising, each, a corresponding plurality of projections 92*a* and 92*b* facing each other. In an advantageous exemplary embodiment, between each plurality of projections 92*a*, 92*b* and translating element 70 a metal sheet 93*a* and 93*b* is arranged, for example of phosphorous bronze, in order to reduce the friction during the movement of translating element 70. This comprises, in particular, a head portion 71, to which lock member 30 is hinged, a tail portion 72 to which actuating lever 25 engages, and operatively connected to resilient means 80, and a connection portion 73.

Figure 9:
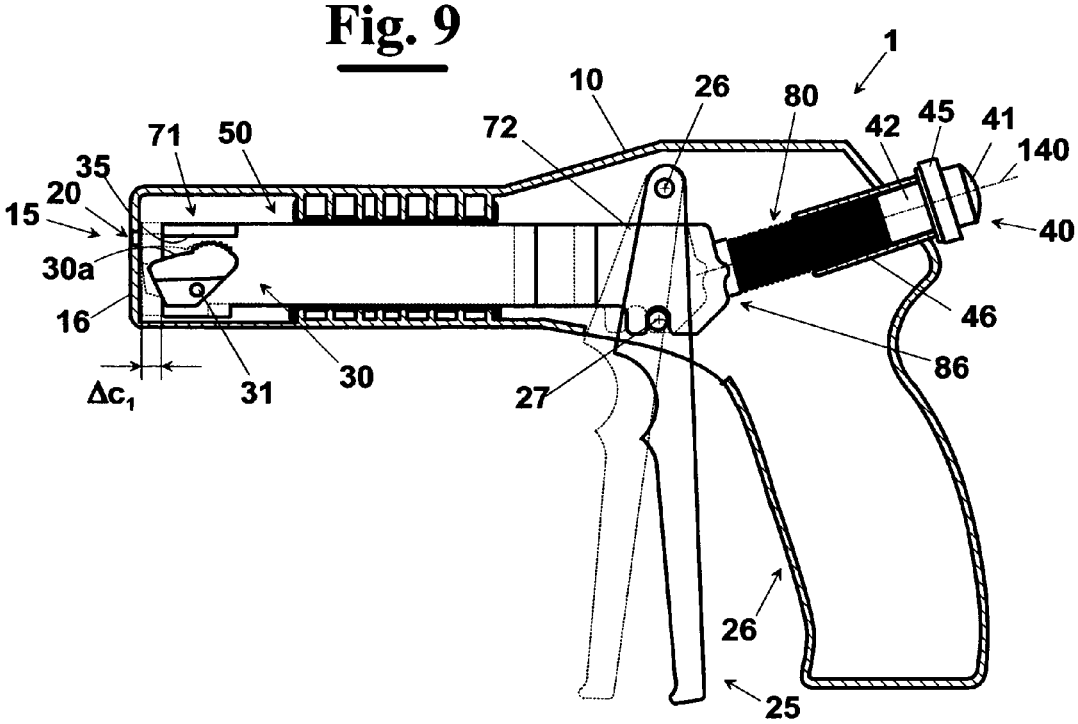
Figure 10:
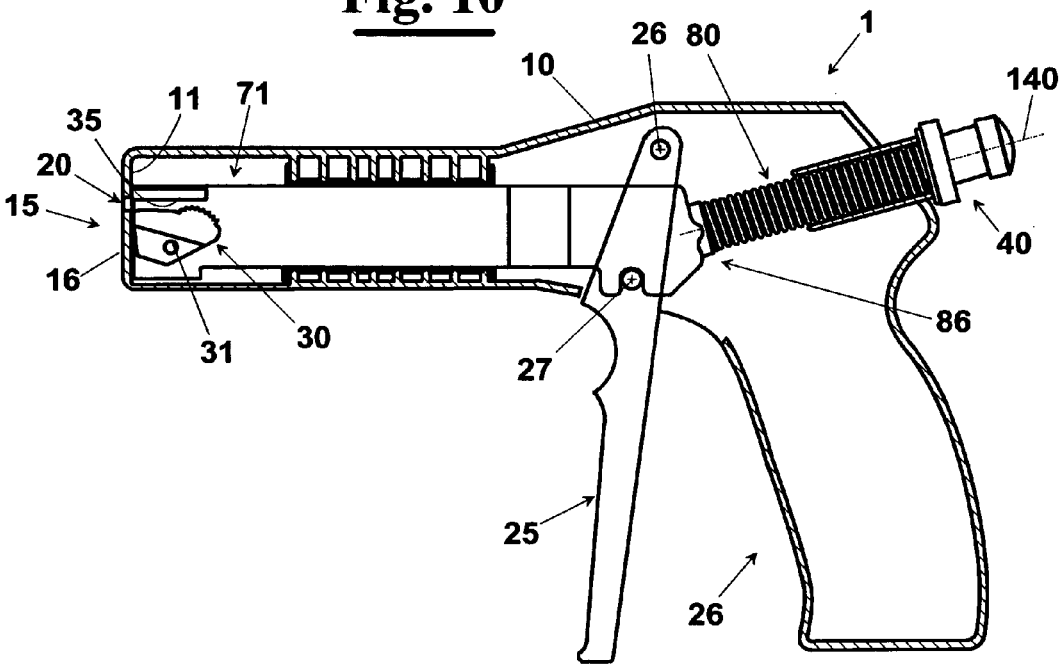

In particular, resilient means 80 applies a resilient force oriented in order to oppose to the movement of translating element 70 from the actual advanced position (FIG. 8) to the withdrawn position (FIG. 9). Resilient means 80 can be housed in a guide 85 that avoids lateral sliding in operation conditions. Resilient means 80 are, furthermore, engaged with tail portion 72 of translating element 70 by means of a connecting element 86, or knob, comprising a recess, or alternatively, a projection, on the edge oriented towards translating element 70, that is adapted to engage with a respective projection, or recess, made on the edge of translating element 70, oriented towards it. The edge of translating element 70 oriented towards knob 86 is advantageously provided orthogonal to the resilient force of resilient means 80.

Figure 15:
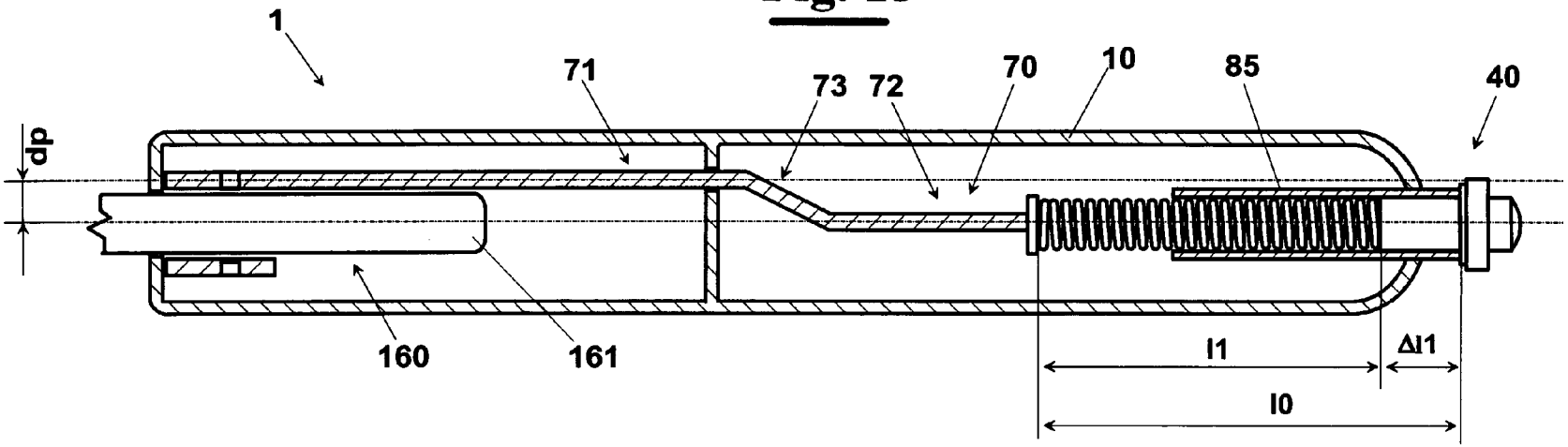
Figure 16:
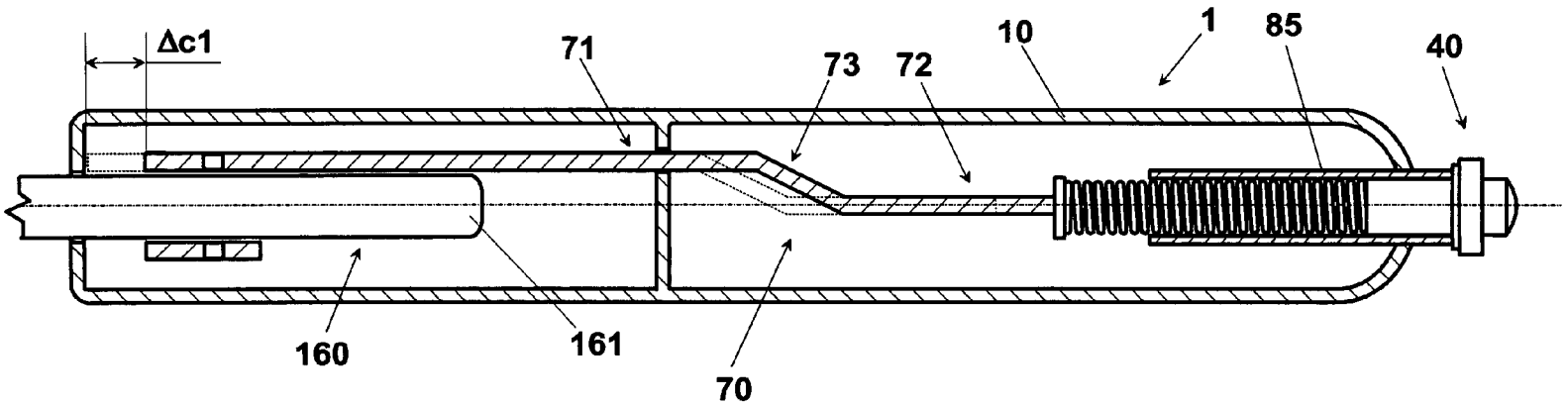

As diagrammatically shown in FIGS. 15 and 16, head portion 71 and tail portion 72 lay in respective planes parallel, at a distance dp that is substantially equivalent to half thickness of actuating lever 25, which can rotate constrained by a pin 27 to the connection portion 73. This way, the side actions to which translating element 70 is subject during the tensioning steps are substantially null, thus avoiding a possible lateral shifting of translating element 70, that would hinder a correct sliding movement.

More in detail, in the starting rest configuration, the resilient force of resilient means 80 on translating element 70 is larger than the resilient force of the torsion spring on lock member 30. Therefore, in this configuration, translating element 70 is in an advanced position and lock member 30, to it hinged, is forced against a inner wall 11 of hollow containing body 10, in order to bring it in the releasing position, in which it is at a distance from abutment surface 35.

When acting on operation lever 25 in a way that exceeds the resilient force of resilient means 80, the user causes the withdrawal of translating element 70 up to the position shown in FIG. 9. This causes lock member 30 to move away from inner wall 11 of hollow containing body 10 and then to rotate up to abutment surface 35 in the locking position owing to the torsion spring. This way, band member 160, which has been preliminarily put in hollow containing body 10 between lock member 30 and abutment surface 35, is subject to a predetermined tension T1 that causes it to withdraw away from support surface 16 for a distance equal to a stroke $\Delta c1$ of translating element 70 (FIG. 16). Support surface 16, during the step of tensioning band member 160, is kept next to portion 120 of device 100. Therefore, the movement of band member 160 from the rest position to the tensioning position causes the movement of device 100 from the first position shown in FIG. 5, in which portion 120 is at a distance from tiles 150*a* and 150*b*, to the second position, shown in FIG. 6, in which portion 120 is arranged next to tiles 150*a* and 150*b* for move them to a same level.

Then, the actuating lever 35 is released and resilient means 80 force again lock member 30 against the inner wall 11 of hollow body 10, bringing it back to the releasing position and freeing, this way, band member 160 that can, then be freely extracted through opening 20.

Figure 17:
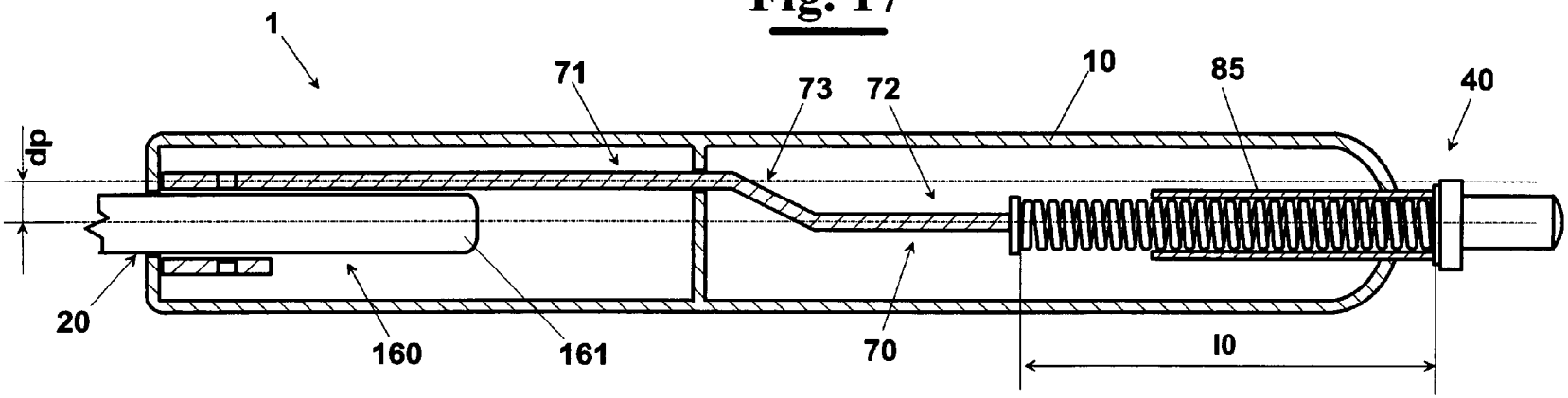
Figure 18:
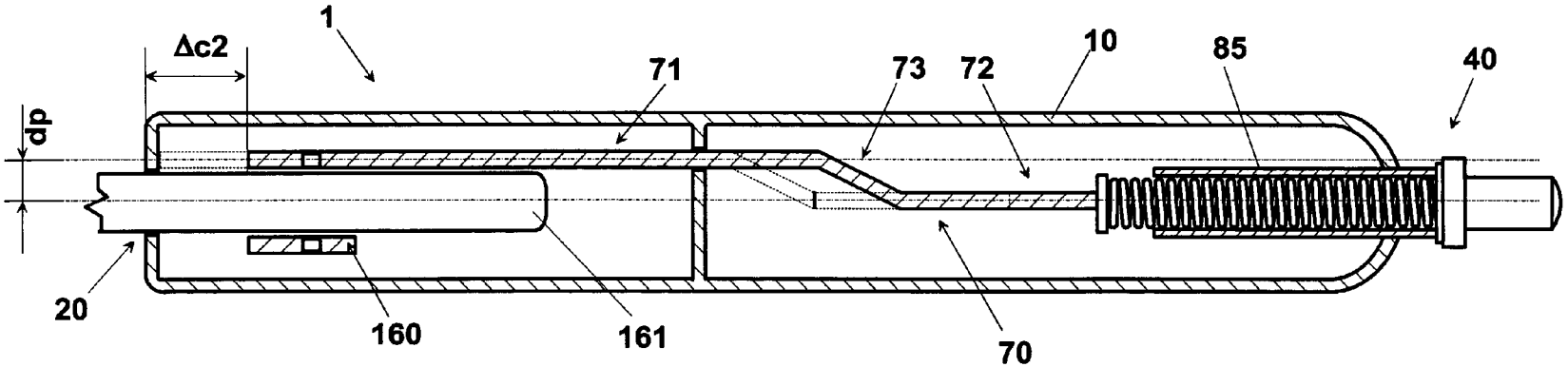

Clip device 100 is then kept in the tile levelling configuration until a glue layer 250 dries, which was spread between surface 200 and tiles 150*a* and 150*b*. Clip device 100 is removed as described hereafter. More in detail, band member 160 is put again in hollow containing body 10 through opening 20 and subject by tensioning means 50 to a tension T2 with T2>T1 up to cause the break of band member 160 from portion 110. This condition is obtained exceeding the resilient force of the spring 80 up to cause a withdrawal of translating element 70 for a length Δc2 back from the advanced position (FIGS. 17 and 18).

Tool 1 applies, therefore, tile laying device 100 in two steps, a first step, in which band member 160 is subject to a tension T1 for causing the movement of device 100 to the second position, and a second step in which band member 160 is subject to an additional tension T2, with T2>T1 for causing it to break from first portion 110. As shown in FIGS. from 15 to 18, during both all the first step and all the second step, end 161 of band member 160 remains in hollow body 10 and band member 160 remains substantially on a same plane and is not therefore sensibly deformed. This makes it possible its use for a new clip device 100.

To assist the laying steps, as above described, tool 1 may have a means 40 for adjusting the load of resilient means 80.

The means 40 for adjusting the load of resilient means 80 can, for example, comprise a push button 41 operatively connected to an actuating pin 42 for causing it to move along a working direction 140. Actuating pin 42 is associated with a ring element 43 that causes it to stop in a predetermined position and engages at one end with resilient means 80. More precisely, the sliding motion of actuating pin 42 along working direction 140 towards resilient means 80 causes the compression of the latter, whereas the sliding motion of pin 40 in the opposite direction reduces the compression of resilient means 80.

Advantageously, before starting the first tensioning step it is possible to act on push button 41 for compressing resilient means 80 up to bringing it to a length $l_1$ in which it is compressed like $\Delta l_1$ with respect to the length at rest $l_0$ (FIG. 15). This way, resilient means 80 applies a high resistance against the compression to which it is subject during the first tensioning step. This way, it is avoided that the user can apply a too strong force on actuating lever 25, which would cause a disengagement of band member 160 during the first tensioning step. In particular, the compression of resilient means 80, carried out by push button 41, allows the user to have a larger sensitivity on actuating lever 25 during the first tensioning step of band member 160. This allows to control an exact tensioning of band member 160 and, then, to reduce the possibility of errors in this operative step.

During the second tensioning step, the user, instead, has to apply an energetic action on actuating lever 25 for causing the break of band member 160 from first portion 110. Therefore, it is preferred, in this case, to decrease the compression of resilient means 80 so that it starts to apply a high resistance only after translating element 70 has moved for a predetermined stroke. Therefore, before starting the second tensioning step, it is preferable to act on push button 41 and to release the preloading force. This way, the length of resilient means 80 is increased with respect to the previous case, for example up to bringing it to the rest length (FIG. 17), and therefore the force that the user has to apply on actuating lever 25 for bringing translating element 70 to an end stop is less than the case where resilient means 80 is pre-loaded.

In an exemplary embodiment shown in FIG. 12A, resilient means 80 has an adjustable pitch, i.e. it comprises a first part having coils 81 with a first pitch P1, for example near translating element 70, and a second part having coils 82 with a second pitch P2, where P2>P1, for example arranged opposite to translating element 70 with respect to the first part having coils 81. In this case, during the first tensioning step, in which it is involved only with the first part having coils 81, the user has to exceed a low resistance, whereas during the second tensioning step, in which it is involved also the second part having coils 82, the user must exceed a larger resistance and therefore the resulting action on band member 160 is much more energetic.

Even if, in FIGS. from 1 to 7, in device 100 band member 160 is always shown connected to first portion 110 and second portion 120 is slidingly arranged on band member 160 with respect to first portion 110, tool 1, according to the invention, can be used also for applying different tile laying devices in which, for example, both first portion 110 and second portion 120 are slidingly mounted along band member 160.

Figure 19:
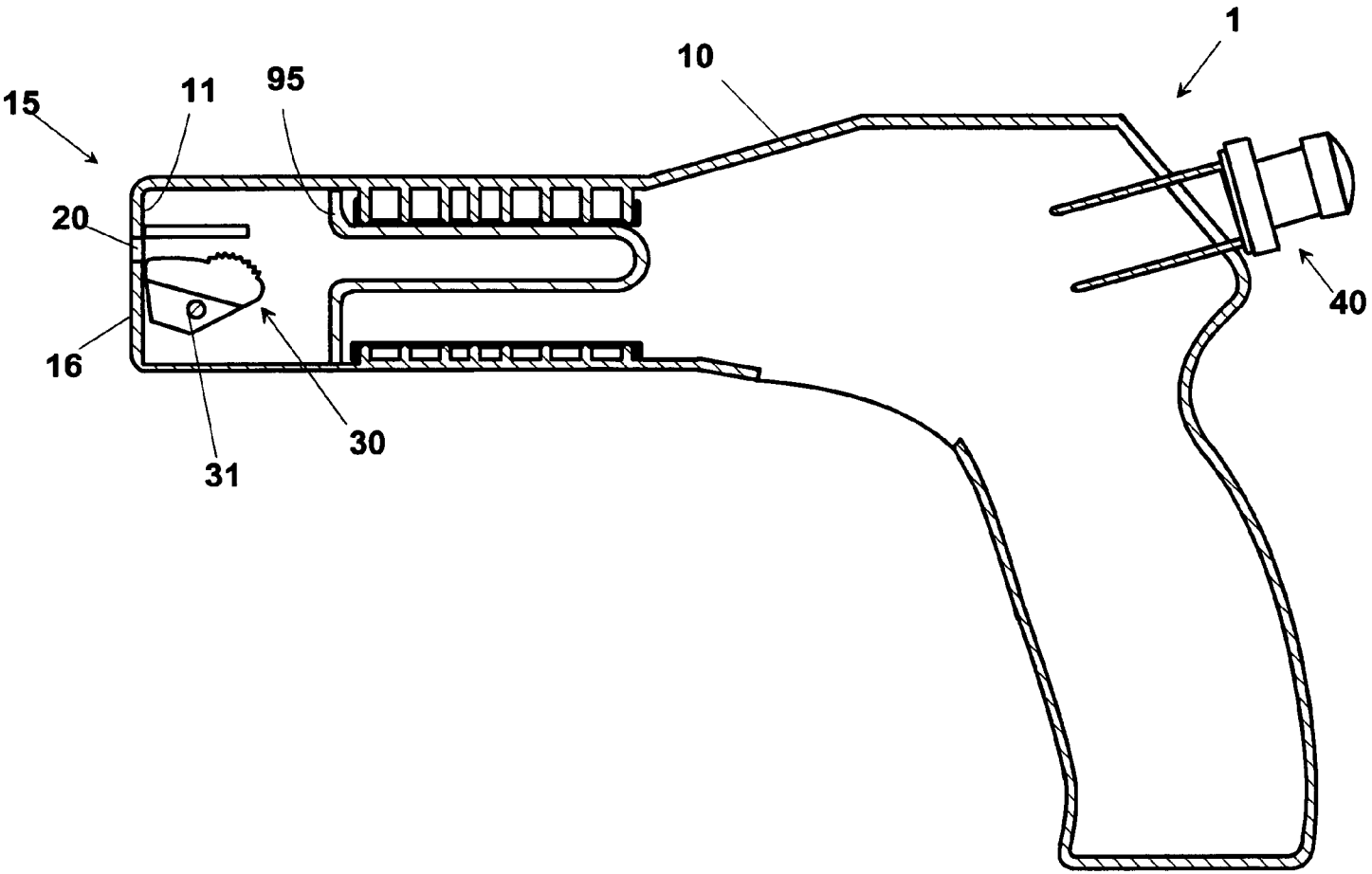

In a further exemplary embodiment, as shown in FIG. 19, between lock member 30 and the guide of translating element 92 a partition wall 95 is provided. More in detail, the presence of partition wall 95 avoids that dust and debris of various nature can penetrate in the mechanical parts of tool 1, jeopardizing a correct operation.

Figure 21:
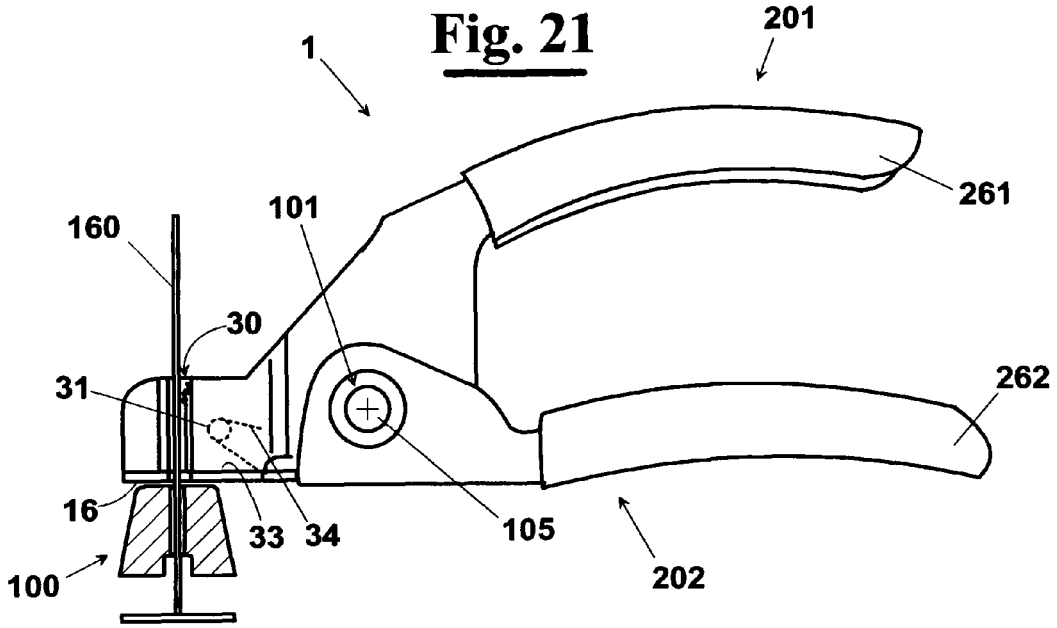
Figure 22:
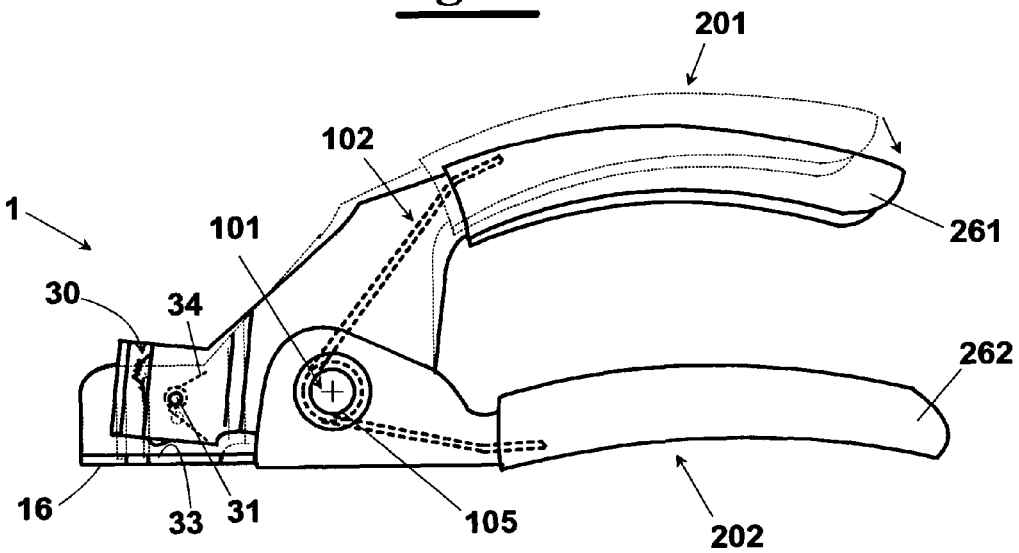

In the exemplary embodiment shown in FIGS. from 20 to 22, the actuating means of manual tool 1 comprises essentially two jaws 201 and 202 having respective handgrip portions 261 and 262. Jaws 201 and 202 are hinged at a rotation point, or pivot point, 101. In particular, a user 250 tightening the two jaws 201 and 202 causes a mutual rotation about pivot point 101. More in detail, two jaws 201 and 202 move from a position, in which the respective handgrip portions 261 and 262 are at a distance from each other (FIG. 21) to a position, in which the respective handgrip portions 261 and 262 are close to each other (FIG. 22). The rotation of jaws 201 and 202 about pivot point 101 can be biased by a torsion spring 102 mounted about a pin 105 located in pivot point 101. In this case, for causing the rotation of jaws 201 and 202 about pivot point 101, the user must exceed the force of the resilient spring 102 that tends to keep handgrip portions 261 and 262 at a distance from each other.

Figure 20:
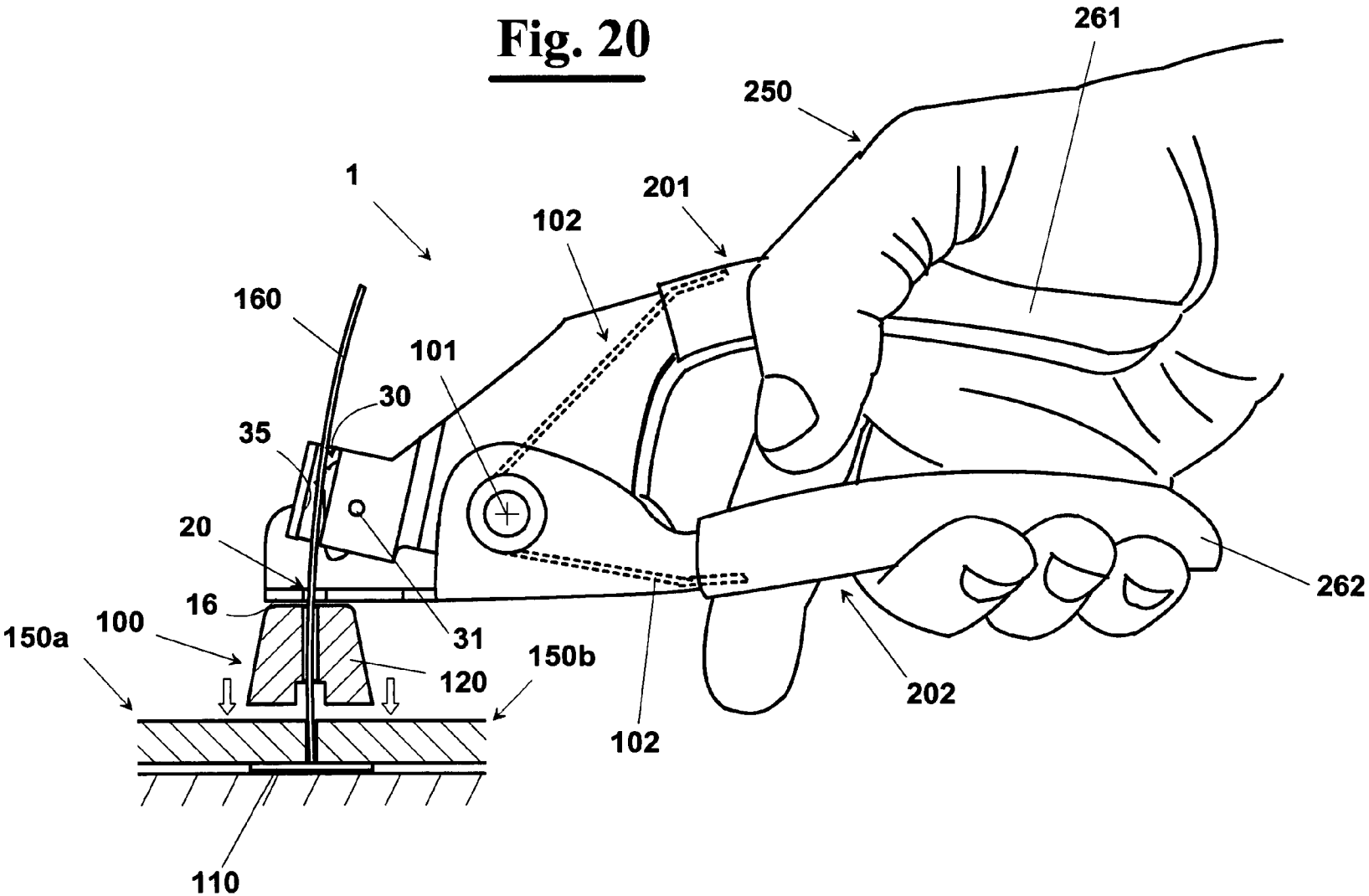

Lock member 30 and abutment surface 35 are integral to jaw 201, whereas support surface 33 is integral to jaw 202. The rotation of jaws 201 and 202 about pivot point 101 causes, then, lock member 30 to move away from support surface 33 and therefore its rotation about pin 31 for the presence of a torsion spring 34. This is adapted to bring lock member 30 against abutment surface 35. Therefore, the rotation of jaws 201 and 202 about pivot point 101, which brings handgrip portions 261 and 262 from a distant position to an approached position to each other, causes the movement of lock member 30 from the actual releasing position, at a distance from abutment surface 35 (FIG. 21), to the locking position, in which it produces a tension on band member 160 up to a predetermined tension (FIGS. 20 and 22).

The foregoing description of a specific embodiment will so fully reveal the invention according to the conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology employed herein is for the purpose of description and not of limitation.

The invention claimed is:

1. Manual tool (1) for application of a tile laying device (100) and similar articles on a surface to coat (200), said tiles having a predetermined thickness, said tile laying device (100) comprising:

a first portion with flat shape equipped with a first face (111) that, in use, is oriented towards said surface to coat (200) and a second face (112) that, in use, is oriented towards a first and a second tile (150*a*,150*b*) at a slit (155) between said tiles (150*a*,150*b*);

a band member (160) protruding from said second face (112) of said first portion (110), said band member (160) arranged, in use, between said tiles (150*a*,150*b*) at said slit (155);

a second portion (120) slidingly arranged along said band member (160) opposite to said first portion (110) in order to be located between a first position, in which the distance between the first portion (110) and the second portion (120) is larger than the thickness of said tiles (150*a*,150*b*), and a second position, in which the distance between the first portion (110) and the second portion (120) is equal to said thickness of said tiles (150*a*,150*b*) and said second portion (120) pushes said tiles (150*a*,150*b*) against said first portion (110) in such a way to bring the tiles (150*a*, 150*b*) to a same level;

wherein said manual tool comprises:

a handgrip (26, 261,262) for a user;

a working head (15) equipped with a support surface (16), said support surface (16) is adapted to be located, in use, next to the second portion (120) of said tile laying device (100) opposite to said tiles (150*a*,150*b*);

an opening (20) made in said working head (16), such that said band member (160) that can be inserted/extracted into/away from said opening (20);

a tensioning means arranged opposite to said tile laying device (100) with respect to said support surface (16), said tensioning means adapted, in use, to engage with said band member (160) of said tile laying device (100) put in said opening (20), for applying on said band member (160) a tension up to reaching a predetermined tension T1, so that said working head (15) pushes said second portion (120) towards said first portion (110) for causing a pushing and levelling action of said tiles (150*a*,150*b*) between said first and said second portions (110,120);

wherein said tensioning means comprises a lock means (30,35) that is adapted to move from a releasing position of said band member (160) to a locking position of said band member (160) in which said tension T1, or a tension T2, with T2>T1 is applied to the band member (160);

wherein said lock means comprises:

an abutment surface (35); and a lock member (30) movable between a releasing position, in which the lock member is at a distance from said abutment surface (35), to make possible an arrangement of said band member (160) between said lock member (30) and said abutment surface (35), through said opening (20), and a locking position, in which said band member (160) is pressed between said lock member (30) and said abutment surface (35);

wherein said lock member (30) has a toothed profile at the surface oriented towards said abutment surface (35).

2. Manual tool (1), according to claim 1, wherein the manual tool. comprises a hollow body (10) which is equipped with said handgrip (26, 261, 262), said working head (15) and said opening (20) made in said working head (15), such that said band member (160) can be inserted/extracted into/away from said hollow body (10) through said opening (20).

3. Manual tool (1), according to claim 2, wherein said tensioning means are housed in said hollow body.

4. Manual tool (1), according to claim 1, wherein said tensioning means, in addition to apply a tension T1 on said band member (160), is adapted to apply an additional tension T2 on said band member (160), with T2>T1, said additional tension T2 suitable for causing the break of said band member (160) from said tile laying device (100).

5. Manual tool (1), according to claim 1, wherein said tensioning means comprises an actuating means that is adapted to bring said lock means (30,35) from said releasing position to said locking position.

6. Manual tool (1), according to claim 5, wherein a resilient means is provided (80,102) that is adapted to oppose to moving said lock means (30,35) from said releasing position to said locking position.

7. Manual tool (1), according to claim 5, wherein said actuating means is adapted to bring said lock means (30, 35) from said releasing position, in which the lock means (30, 35) is arranged at contact of an abutment surface (33) opposite to said support surface (16), to said locking position, in which the lock means is at a distance from said abutment surface.

8. Manual tool (1), according to claim 5, wherein said actuating means is adapted to rotate said lock means (30,35) from said releasing position to said locking position.

9. Manual tool (1), according to claim 5, wherein said actuating means is adapted to translate said lock means (30, 35) from said releasing position to said locking position.

10. Manual tool (1), according to claim 1, wherein said abutment surface (35) and said lock member (30) are mounted on said actuating means.

11. Manual tool (1), according to claim 1, wherein said lock member (30) is pivotally connected to one end portion of the actuating means and said abutment surface (35) is integral to a same end portion of said actuating means.

12. Manual tool (1), according to claim 1, wherein said toothed profile of said lock member has a plurality of teeth having an angle of incidence set between 5° and 120°.

13. Manual tool (1), according to claim 5, wherein said actuating means comprises:

a translating element (70) sliding along a sliding direction biased by resilient means (80);

an actuating lever (25) operatively connected to said translating element (70) on which a user can act for bringing said manual tool (1) from a rest configuration, in which said translating element (70) is in an advanced position and said lock means (30, 35) is in said releasing position, to an operative configuration, in which said translating element (70) is in a withdrawn position and said lock means (30,35) is in said locking position.

14. Manual tool (1), according to claim 1, wherein said lock member (30) is associated with a torsion spring (34) that is adapted to apply a resilient torque on said lock member (30) up to bring the lock member (30) to said locking position, in said rest configuration said resilient means (80) adapted to apply on said translating element (70) a resilient force larger than the resilient force of said torsion spring (34), such that the resilient means (80)) forces the lock member (30) against the abutment surface (33) maintaining the lock member (30) in the releasing position, in which it is possible to put said band member between said lock member (30) and said abutment surface (35), in said operative configuration, instead, a acting on said actuating lever (25) can exceed said resilient force of said resilient means (80) to cause the withdrawal of said translating element (70) with respect to said support surface (16) and a subsequent movement of said lock member (30) from said releasing position to said locking position by said torsion spring (34).

15. Manual tool (1), according to claim 13, wherein said resilient means (80) is adapted to apply on said translating element (70) a resilient force oriented along a pushing direction selected from the group comprised of:

a pushing direction parallel to said sliding direction;

a pushing direction at a predetermined angle with respect to said sliding direction.

16. Manual tool (1), according to claim 1, wherein said opening (20) through which said band member (160) is put in said working head (15) comprises a first portion that is located at said support surface (16) and a second portion that is located at a side face of said working head (15).

17. Manual tool (1), according to claim 6, wherein an adjustment means is provided for adjusting said resilient force, or load, of said resilient means (80,102), said adjustment means adapted to set a predetermined resilient force selected among a plurality of predetermined resilient forces.

18. Manual tool (1), according to claim 6, wherein said adjustment means is adapted to set a larger force when the tensioning means applies the above described tension T1 on said band member (160) and a lighter force when the tensioning means applies the above described tension T2 on said band member (160).

19. Manual tool (1), according to claim 13, wherein said translating element (70) is slidingly mounted between a couple of guides (93*a*,93*b*) arranged at opposite sides with respect to said translating element (70).

20. Manual tool (1), according to claim 19, wherein each guide (91*a*,91*b*) comprises a plurality of projections (92*a*, 92*b*) oriented towards the recess of the hollow containing body, between each guide (93*a*,91*b*) and the translating element a metal sheet is located that is adapted to reduce friction during the sliding movement of said translating element (70).

21. Manual tool (1), according to claim 19, wherein said resilient means comprises a first part having coils with a first pitch P1 and at least one second part having coils with a second pitch P2, with P2>P1.

22. Manual tool (1), according to claim 13, wherein said translating element (70) has a profiled shape comprising:

a head portion (71) arranged on a first plane, to said head portion (71) said lock member (30) being pivotally connected;

a tail portion (72) arranged on a second plane parallel to said first plane and arranged at a predetermined distance from the first plane, said tail portion (72) constrained to said actuating lever (25);

a connection portion (73) between said head portion (71) and said tail portion (72).

23. Manual tool (1), according to claim 13, wherein said actuating lever (25) is pivotally connected to said tool (1) in a first point with respect to which the actuating lever (25) can rotate and engages with said translating element (70) at a second point, the rotation of said actuating lever (25) about said first point causing a sliding movement of said translating element (70) along said sliding direction.

24. Manual tool (1), according to claim 6, wherein said resilient means (80) is located in a guide (85) that is adapted to avoid undesired lateral movements.

25. Manual tool (1), according to claim 1, wherein a means is provided for stopping the sliding movement of said translating element (70) at a predetermined distance from said support surface (16), said distance at which said sliding is stopped corresponding to the stroke of said translating element (70) for bringing said first and said second portions (110,120) of said device (100) from said first to said second position.

26. Manual tool (1), according to claim 1, wherein said translating element (70) and said resilient means (80) have mutual engagement means.

27. Manual tool (1), according to claim 1, wherein said actuating means comprises a first and a second jaw (201,202) having respective handgrip portions (261,262), said first and said second jaws (201,202) being pivotally connected to each other.

28. Manual tool (1), according to claim 27, wherein said first and said second jaws (201,202) are adapted to rotate with respect to a rotation point, or pivot point, (101) biased by resilient means (102) for moving from a rest configuration, in which said handgrip portions (261,262) are at a distance from each other and said band member (160), put in said opening (20), is not subject to any traction force, and a tension configuration, in which said handgrip portions (261,262) are close to each other and said band member (160), put in said opening (20), is subject to said traction.

29. Manual tool (1), according to claim 1, wherein said lock member (30) and said abutment surface (35) are integral to said first jaw (201), whereas said support surface (16) is integral to said second jaw (202), the rotation of said first and of said second jaws (201,202) about said pivot point (101) causing a detachment of said lock member (30) from said support surface (35) and then movement of the lock member (30) from said releasing position to said locking position.

30. Manual tool (1), according to claim 29, wherein a first torsion spring (102) is provided that is adapted to oppose to the movement of said handgrip portions (261,262) from said distant position to said approached position and a second torsion spring (34) is provided associated with said lock member (30), said second torsion spring (34) adapted to bring said lock member (30) in said locking position.

* * * * *